US005603224A

United States Patent [19]

Scaringe et al.

[11] Patent Number: 5,603,224

[45] Date of Patent: Feb. 18, 1997

[54] PORTABLE REFRIGERANT RECOVERY SYSTEM

[75] Inventors: Robert P. Scaringe; Fulin Gui, both of Rockledge; Steven D. Gann, Merritt Island, all of Fla.

[73] Assignee: Mainstream Engineering Corporation, Rockledge, Fla.

[21] Appl. No.: 549,065

[22] Filed: Oct. 27, 1995

Related U.S. Application Data

[62] Division of Ser. No. 405,681, Mar. 17, 1995.

[51] Int. Cl.[6] ..... F25B 49/00

[52] U.S. Cl. ..... 62/125; 62/149; 62/292

[58] Field of Search ..... 62/77, 85, 125, 62/292, 475, 126; 137/559, 487.5, 561 A

[56] References Cited

U.S. PATENT DOCUMENTS

| | | | |
|---|---|---|---|
| 4,110,998 | 9/1978 | Owen | 62/125 |
| 4,261,178 | 4/1981 | Cain . | |
| 4,363,222 | 12/1982 | Cain . | |
| 4,441,330 | 4/1984 | Lower et al. . | |
| 4,516,603 | 5/1985 | Mock | 62/292 |
| 4,539,817 | 9/1985 | Staggs et al. . | |
| 4,688,388 | 8/1987 | Lower et al. . | |
| 4,766,733 | 8/1988 | Scuderi . | |
| 4,809,515 | 3/1989 | Houwink . | |
| 4,809,520 | 3/1989 | Manz et al. . | |
| 4,967,570 | 11/1990 | Van Steenburgh, Jr. . | |
| 4,998,416 | 3/1991 | Van Steenburgh, Jr. . | |

*Primary Examiner*—John M. Sollecito

*Attorney, Agent, or Firm*—Evenson, McKeown, Edwards & Lenahan, P.L.L.C.

[57] ABSTRACT

A portable, electrically powered refrigerant recovery system and method uses a single manifold to reduce fabrication time and costs. A hot gas discharge port in combination with a check valve allows the recovery system to be utilized as a vacuum pump as well as a refrigerant recovery device. A rectangular aluminum oil separator has internal baffles and is located between the inlet and a compressor. A low-voltage control circuit uses a latching circuit to avoid short cycling of the compressor and thereby increase compressor life. The system provides an improved push-pull recovery method in which superheated refrigerant vapor from the compressor is diverted directly to the system being recovered so that the superheated vapor is returned to the unit being emptied to speed the recovery process.

2 Claims, 11 Drawing Sheets

PORTABLE REFRIGERANT RECOVERY SYSTEM

This is a divisional of application Ser. No. 08/405,681, filed Mar. 17, 1995.

BACKGROUND AND SUMMARY OF THE INVENTION

The present invention relates to a refrigerant recovery system and, more particularly, to a portable, electrically powered refrigerant recovery system which uses a single manifold to simplify manufacturing and assembly costs, a rectangular oil separator having internal baffles and being located between the manifold and a compressor, and a low-voltage control circuit which uses a latching circuit to avoid short cycling of the compressor and thereby increase compressor life. The present invention also relates to an improved push-pull recovery method in which superheated refrigerant vapor from the compressor is diverted directly to the manifold so that the vapor is returned to the unit being emptied to speed the recovery process.

Federal law now requires recovery of refrigerant from vapor-compression heat pumps, air conditioners and refrigerators to avoid perceived danger to the Earth's ozone layer. Refrigerant recovery machines are well known and are generally of the type shown schematically in FIG. 1 in which a compressor, and sometimes also a pump, is used to remove or recover the refrigerant from the system. The compressor in the direct vapor recovery system of FIG. 1 removes vapor from a system (not shown) in which oil has been separated from the vapor by passage through an oil separator/reservoir which receives the refrigerant vapor directly from the system being evacuated, and the compressed vapor is condensed prior to being stored in a tank (not shown) via the outlet connection.

A variety of refrigerant recovery systems, as well as refrigerant reclaiming processes, have been proposed as seen, for example, in U.S. Pat. Nos. 4,261,178; 4,363,222; 4,441,330; 4,539,817; 4,688,388; 4,766,733; 4,809,515; 4,809,520; 4,967,570; 4,998,416; 5,050,401; 5,072,593; 5,086,630; 5,090,2114 5,101,641; 5,176,008; 5,243,832; 5,291,743 and 5,357,768. Generally speaking, however, we have recognized that these various systems have disadvantages such as unduly complicated and costly manifold arrangements, the need for electrical heaters to vaporize incoming liquid refrigerant, impaired reliability due to the presence of control and back-up thermostats and sensitivity to intermittent opening and closing of safety switches resulting in shortened compressor life due to short cycling.

By way of example, U.S. Pat. No. 4,809,520 describes a portable recovery system which uses an input manifold which, in a manner similar to above-discussed FIG. 1, is connected to a combination heat exchange/oil-separation unit through a solenoid valve and has conventional valves and pressure gauges. The evaporator section of the unit is connected to the input of a compressor. The outlet of the compressor is connected to the condenser portion of the unit and, through a check valve and a pair of manual valves, to a refrigerant storage container. The evaporation portion of the heat exchange/oil-separation unit has a sloped internal baffle projecting downwardly from the top of the canister to force incoming refrigerant outwardly beneath the canister top. Likewise, the unit outlet has a sloped baffle. The condenser portion of the unit has a closed condenser coil comprising inner and outer coils. In operation, incoming liquid or mixed liquid and vapor refrigerant from the system being evacuated is fed into the evaporation portion, and the liquid refrigerant falls by gravity onto and around the coil. Vapor from the compressor outlet is fed to the coil where heat is transferred to the liquid refrigerant falling onto and surrounding the coil, and the condensed liquid is fed to the storage container. The heated liquid refrigerant surrounding the coil is thus evaporated and supplied to the compressor inlet. However, the combined evaporator, compressor and oil separator requires a relatively complicated construction.

It is an object of the present invention to overcome the problems and disadvantages associated with known refrigerant recovery system and to provide a system of the aforementioned type which is highly reliable, relatively simple in construction and operation, and inexpensive to manufacture and maintain.

It is yet another object of the present invention to provide a portable, electrically powered refrigerant recovery system which utilizes a single or unitary inlet/outlet manifold to provide a less costly manifold by incorporating several components such as ports, pressure relief valves, high and low pressure switches and gauges therein.

It is still a further object of the present invention to provide a less costly manifold which reduces constructional costs and time by incorporating a number of components such as ports and gauges therein.

Yet another object of the present invention is to provide a hot gas discharge port which, in combination with a check valve, permits the recovery system to be used as a vacuum discharge pump which can draw a vacuum on a system before being refilled with refrigerant.

Another object of the invention is to control the refrigerant recovery system in a manner which avoids short cycling of the compressor, which short cycling severely reduces compressor life.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
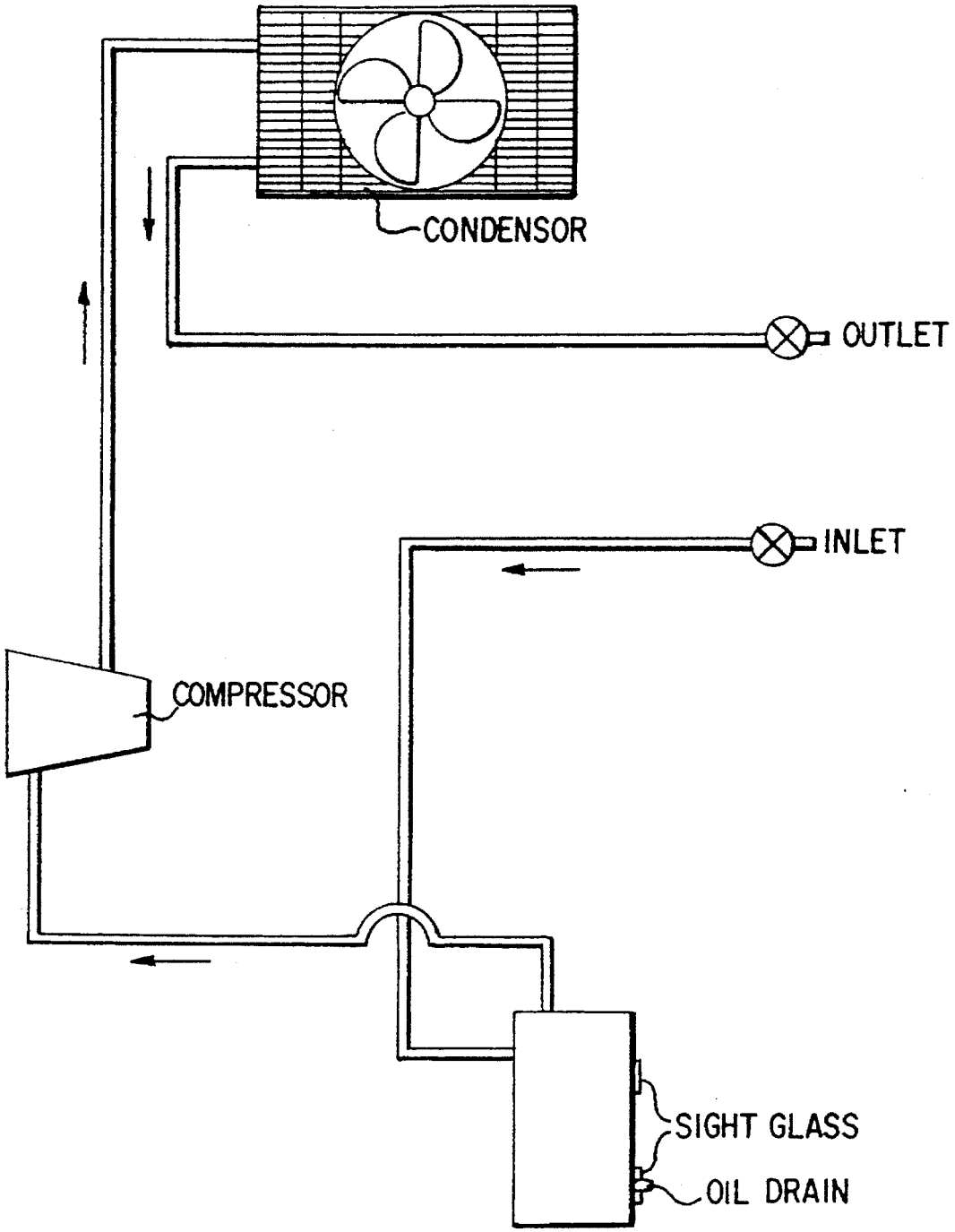
FIG. 1 PRIOR ART
FIG. 1 is a schematic diagram of a generally known form of refrigerant recovery system discussed above.
Figure 2:
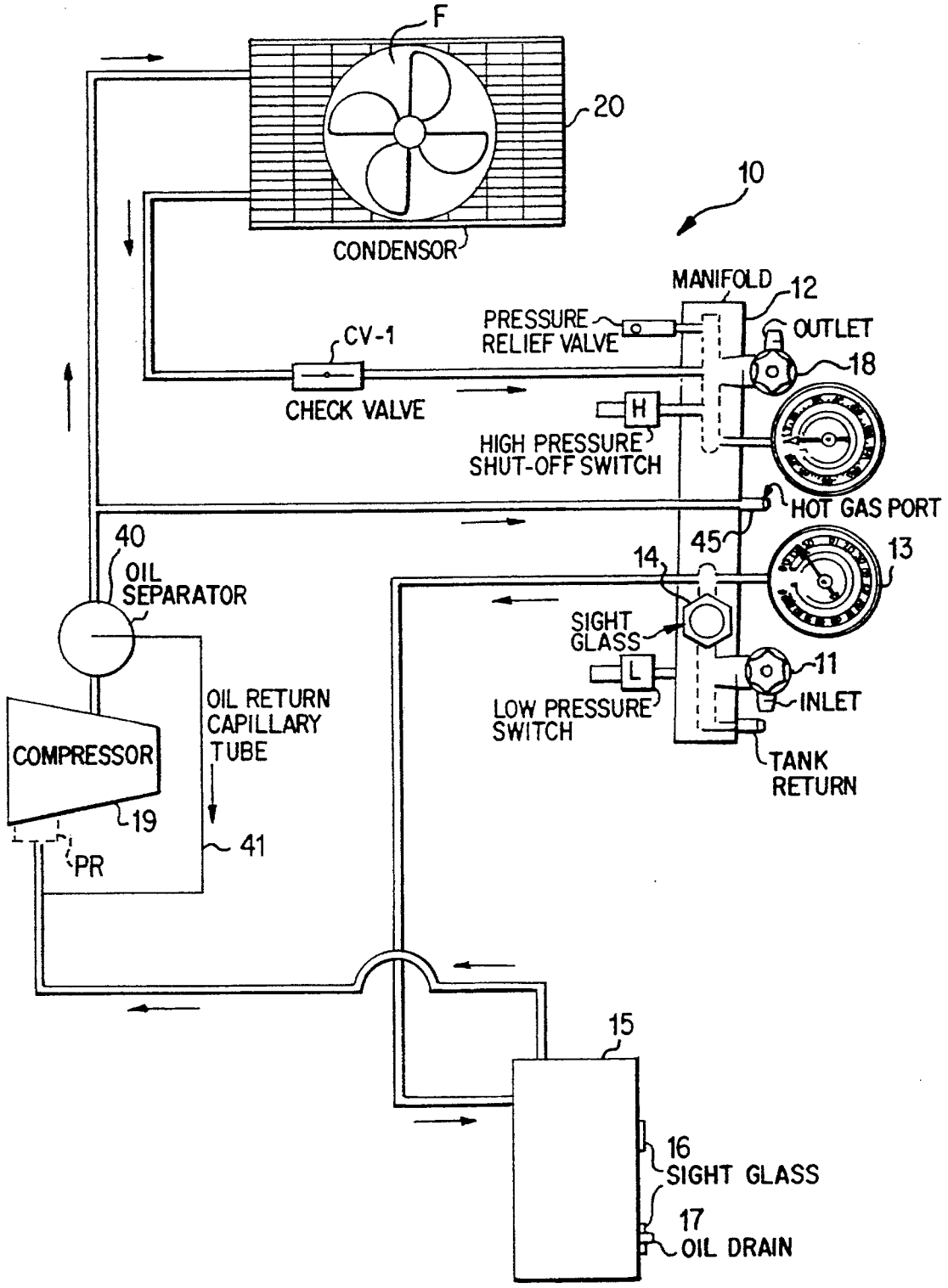
FIG. 2 is a schematic diagram of a refrigerant recovery system using a unitary inlet/outlet manifold in accordance with the present invention.

Referring now to FIG. 2, a flow path for a refrigerant in the recovery system of the present invention designated generally by the numeral 10 is illustrated schematically and, generally speaking, is similar to the cycle described with respect to FIG. 1. It should be understood that all of the components shown, except for the system being emptied and a storage tank, will be in practice arranged inside a compact cabinet with switches, warning lights, etc. being mounted on an instrument panel in the cabinet. Refrigerant enters the recovery unit 10 via the inlet valve 11 on the unitary inlet/outlet manifold 12 described in greater detail below with reference to FIG. 3.

The inlet passageway of the valve 11 is in fluid communication with an inlet pressure gauge 13 in the manifold 12, so that the system operator can monitor the inlet pressure. The inlet refrigerant can also be viewed by the operator via an integrated inlet sight glass 14, e.g. a standard threaded sight glass (cover glass), such as a Parker sight glass cover with a moisture indicating element, located in the manifold inlet passageway.

Figure 3:
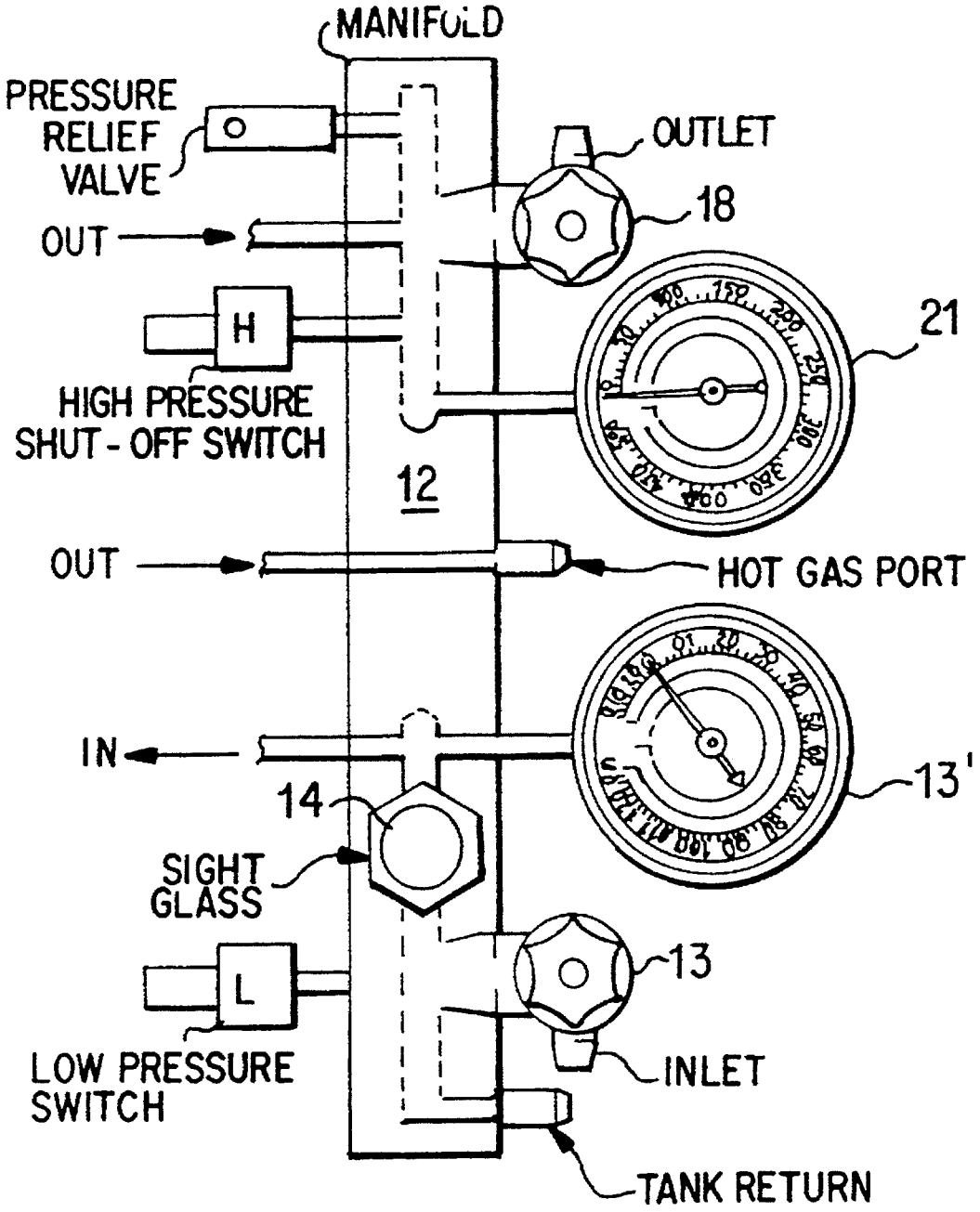
FIG. 3 is an isolated, enlarged view of the unitary inlet/outlet manifold shown in FIG. 2.

FIG. 3 illustrates in more detail the inlet and outlet manifold 12 fabricated from a single or unitary piece. The manifold 12 reduces fabrication time and costs because this single component has the dual inlet ports, inlet sight glass 14, low-pressure gauge 13', high pressure gauge 21, push-pull transfer, or hot gas, port, the recovery outlet port 18, low- and high-pressure shut-off switches or sensors, pressure relief valve and an optional vacuum discharge port machined therein to avoid the need for numerous individual connections. The manifold 12 is also now an easily removable, integral subassembly which permits the valves, gauges, and sight glass to be easily removed and/or replaced by service personnel.

Figure 4:
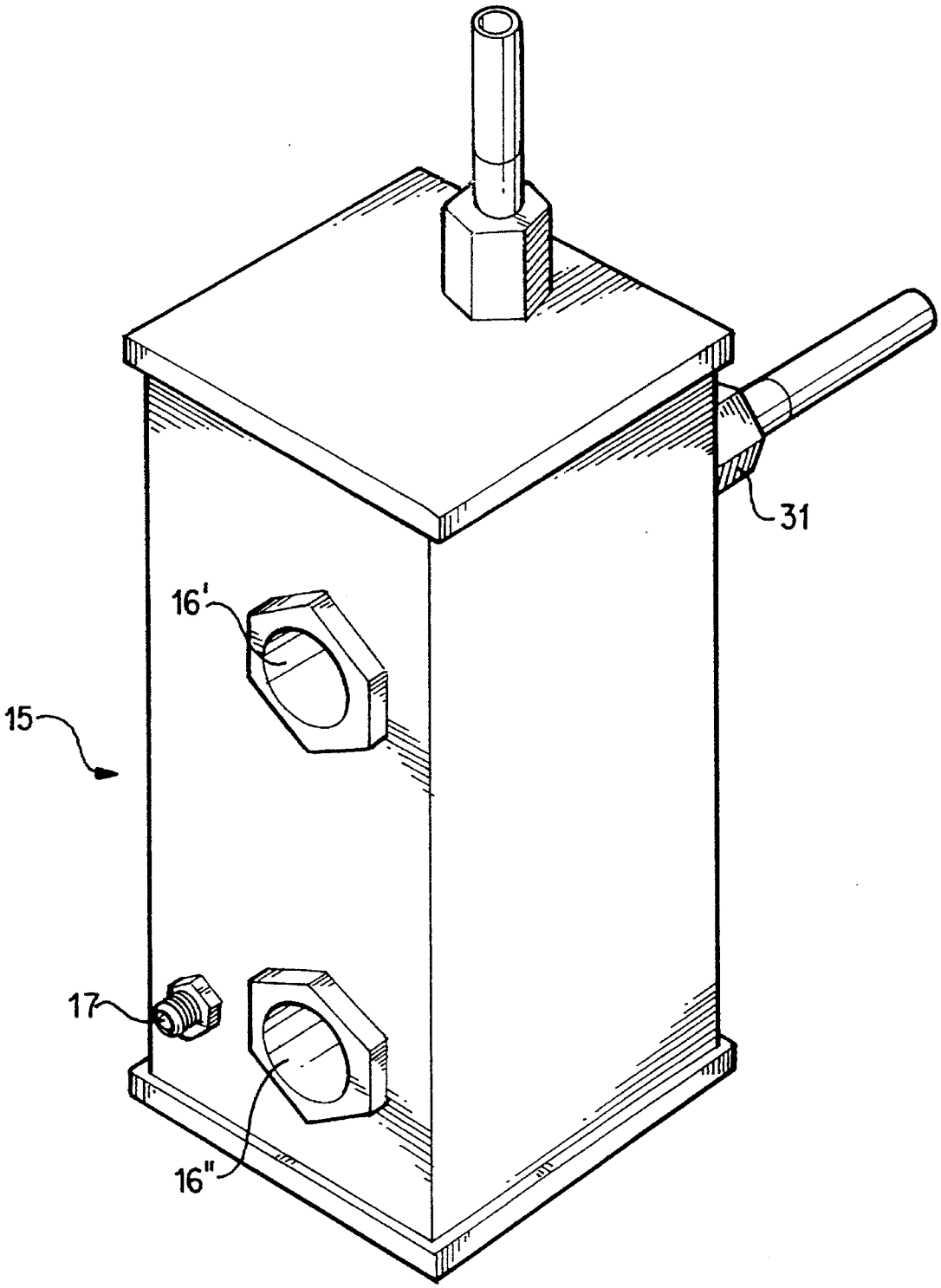
FIG. 4 is a perspective view of the oil separator/reservoir used in the system of FIG. 2.

The inlet refrigerant leaves the manifold 12 and travels to an oil separator 15 shown in greater detail in FIG. 4. The separator 15 is fabricated with high and low oil level sight glasses 16', 16" (such as a Parker-type with moisture indicating element) to allow the operator to visually determine the oil level. The oil separator 15 in the currently preferred embodiment is made from rectangular, rather than round, tubing stock material to allow the oil separator 15 to fit tightly against a front panel (not shown) of the unit 10 where the oil sight glasses 16 can be easily read. An oil draining operation is also easily accomplished by utilizing a self-sealing, Schrader-type valve 17 directly threaded into the oil separator 15.

The oil separator 15 has internal baffles designated generally by numeral 4. The baffles 4 require the moving refrigerant to travel a tortuous upward path therearound. Entering through the inlet 31 of the oil separator 15, liquid refrigerant, oil and any hard particles, due to their greater density and, therefore, greater inertial effects, tend to impact on the baffles 4, coagulate due to surface tension effects and flow downward due to the action of gravity on the resulting liquid mixture. The fluid velocity of the incoming refrigerant vapor and entrained oil is also reduced by the expansion of the flow cross-sectional area as the fluid enters the oil separator 15 which has a significantly greater cross-sectional flow area compared to the supply plumbing. The expansion effect results in disproportionately greater deceleration of the vapor because of its substantially lower specific mass. The oil droplets, which are not significantly slowed down relatively speaking, tend to impact on the chamber walls and baffles. The baffles 4 are oriented to slope downward to facilitate the flow of the separated liquid mixture toward the base of the separator 15.

Figure 4A:
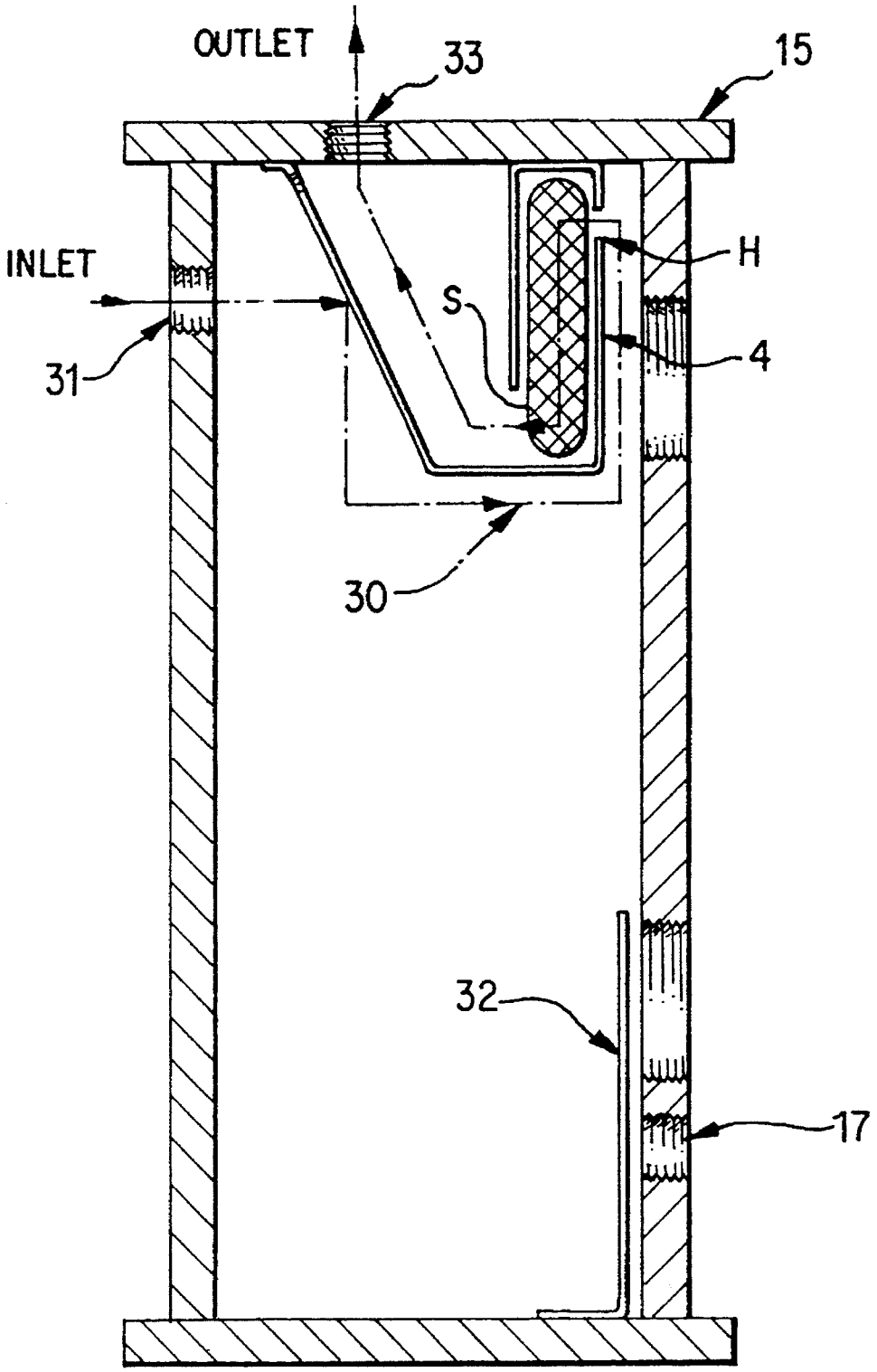
FIG. 4A is a cross-sectional side view of the oil separator/reservoir shown in FIG. 4.

As illustrated in FIG. 4A the flow direction of the liquid refrigerant, oil and hard particles (shown in dot-dash lines 30) is turned seven times in the separator 15, with each turn (except the last turn) being approximately 90 degrees. When the flow of liquid and vapor refrigerant, hard particles, and oil enter the oil separator 15 through the inlet 31 on the side, at relatively high velocity-compared to the velocity within the separator 15 itself, the flow is blocked by the baffle assembly 4 and forced by the baffle configuration to flow in a downward direction. The denser liquid, i.e. oil or liquid refrigerant, with its greater momentum, impacts on the baffle assembly 4 and is retained thereat. Gravity causes this liquid to accumulate on the base of the baffle and drain into the reservoir below. The baffle 4 then redirects the flow first horizontally, then vertically. After the flow impacts on another baffle surface, it is forced to pass through holes H in the baffle 4. The majority of the liquid and hard particles have already been separated at this point. For the fine liquid mist that may remain entrained in the vapor, however, a fine-mesh filter screen S is used to catch this liquid mist, as the flow through the baffle's holes is forced past through screen S. The downward flow which emerges from the screen S is forced once again to turn horizontally as it exits the screen S and impacts once again on the baffle 4. This horizontal flow is then redirected upward when it impacts the last baffle surface (inclined about 65 degrees from the horizontal) on its path to the oil separator's vapor exit 33. The sides of the baffle assembly 4 are open to allow any trapped oil to drain from the sides into the oil reservoir.

Oil and suspended hard particles are removed from the oil separator 15 at the waste oil drain 17 (FIG. 2) near the lower sight glass 16. Hard particles which are not suspended in the oil fall to the base in the separator 15. Although the quantity of such hard particles is very small, separation of these hard particles from the vapor stream is very important. By locating the waste oil drain 17 off the bottom of the oil separator's reservoir, the unsuspended hard particles remain trapped, and because their quantity is minimal, this accumulation of hard particles never becomes a significant problem. If it were desired at some point to remove these particles, however, the sight glass covers can be removed, and the separator completely cleaned or the unit tipped. Alternatively, the oil drain 17 can be located at the lowest point in the oil separator's reservoir so that the particles and oil can be removed together.

The vapor stream shown by the dash lines in FIG. 4A is also forced in an upward direction to utilize any direct gravitational separation that may also be possible due to the greater density of the liquid and hard particles. The flow cross-sectional area in the separator 15 is significantly increased compared with the piping before and after the separator 15 so as to reduce the vapor velocity therein and thereby significantly reduce the capability of the vapor to drag the oil and hard particles along with the vapor.

The oil separator's dual sight glasses 16', 16" can be read easily, regardless of the lack of light reflection inside the oil separator 15 and without the use of a flashlight, by providing aluminum sheet metal 32 inside the oil separator about 0.25" behind the lower sight glass 16". This sheet 32 serves to reflect light passing through the sight glass 16" and makes the oil level more easily visible.

Refrigerant vapor leaves the oil separator 15 from the outlet 33 at the top thereof and travels toward the compressor 19 (FIG. 2). A conventional filter dryer is not used in this embodiment because recovery, and not recycling, is the primary goal. If, however, further refrigerant clean-up is desired, a standard filter/dryer can be located between the oil separator 15 and the inlet to the compressor 19 without departing from the spirit of the present invention. In a practical embodiment, lines from the separator 15 to the compressor 19 are sloped toward the separator 15 to allow any transmitted oil which is subsequently separated in the line to drain back into the separator 15. As previously noted, waste oil and hard particles accumulate in the separator 15 and are removable from the lower front of the separator via a conventional self-sealing, Schrader-type valve 17 threaded directly into the waste oil separator 15.

Another contemplated embodiment of the present invention utilizes a conventional crankcase pressure regulator PR (shown in dotted lines in FIG. 2) at the inlet to the compressor. That is, the regulator PR is provided between the oil separator 15 (or, if used, the filter dryer) and the compressor 19 to avoid high inlet pressures from reaching the compressor inlet. Otherwise, a high inlet pressure can result in a higher than normal outlet pressure, thereby resulting in compressor damage and/or compressor overload.

Refrigerant exits the compressor 19 as a superheated vapor with some entrained oil essentially from the compressor 19 and not from the inlet waste oil separator. This oil, though not large in quantity, must be returned to the compressor 19 through the use of commercial oil separators which can be used within the scope of the present invention. We have found that a conventional centrifugal separator 40 is the most effective and economic. Generally speaking, incoming refrigerant and entrained oil tangentially enters the separator 40 to a large cylindrical chamber, to reduce the vapor velocity. The inertial effects of the denser oil cause it to impact the side walls, and gravity causes the oil to collect at the base of the centrifugal separator. The vapor travels in a spiral upward path to an exit at the top of the separator 40. For simplified construction, no baffles are used because the oil fractions are lower that exhibited in the waste oil separator 15. The oil which collects in the base of the separator 40 passes through a screen and is returned to the low pressure side of the compressor 19 (where the oil resides in the suction-side-pressure crankcase) via a capillary tube 41 which throttles the oil pressure back to the compressor inlet pressure. The capillary tube 41 must be appropriately sized both as to diameter and length, to minimize the overall refrigerant flow back from the outlet to the inlet since this in non-productive circulation of the refrigerant.

Again in a practical embodiment, the piping leaving the centrifugal separator 40, is sloped so that any oil separating out will gravity-drain back thereto where it can then be returned to the compressor 19 via the capillary tube 41. Refrigerant leaving the oil separator 40 travels to the condenser 20 configured here as a forced air condenser where the refrigerant is condensed to a liquid form by removal of heat. The forced air condenser 20 can, however, be water-cooled in a known manner instead of air-cooled as shown. Liquid refrigerant then exits the condenser 20 and travels to the manifold 12 where it is operatively arranged to the liquid outlet valve 18. An outlet pressure gauge 21 is operatively arranged in fluid communication with the outlet 18 within the manifold 12.

Figure 2A:
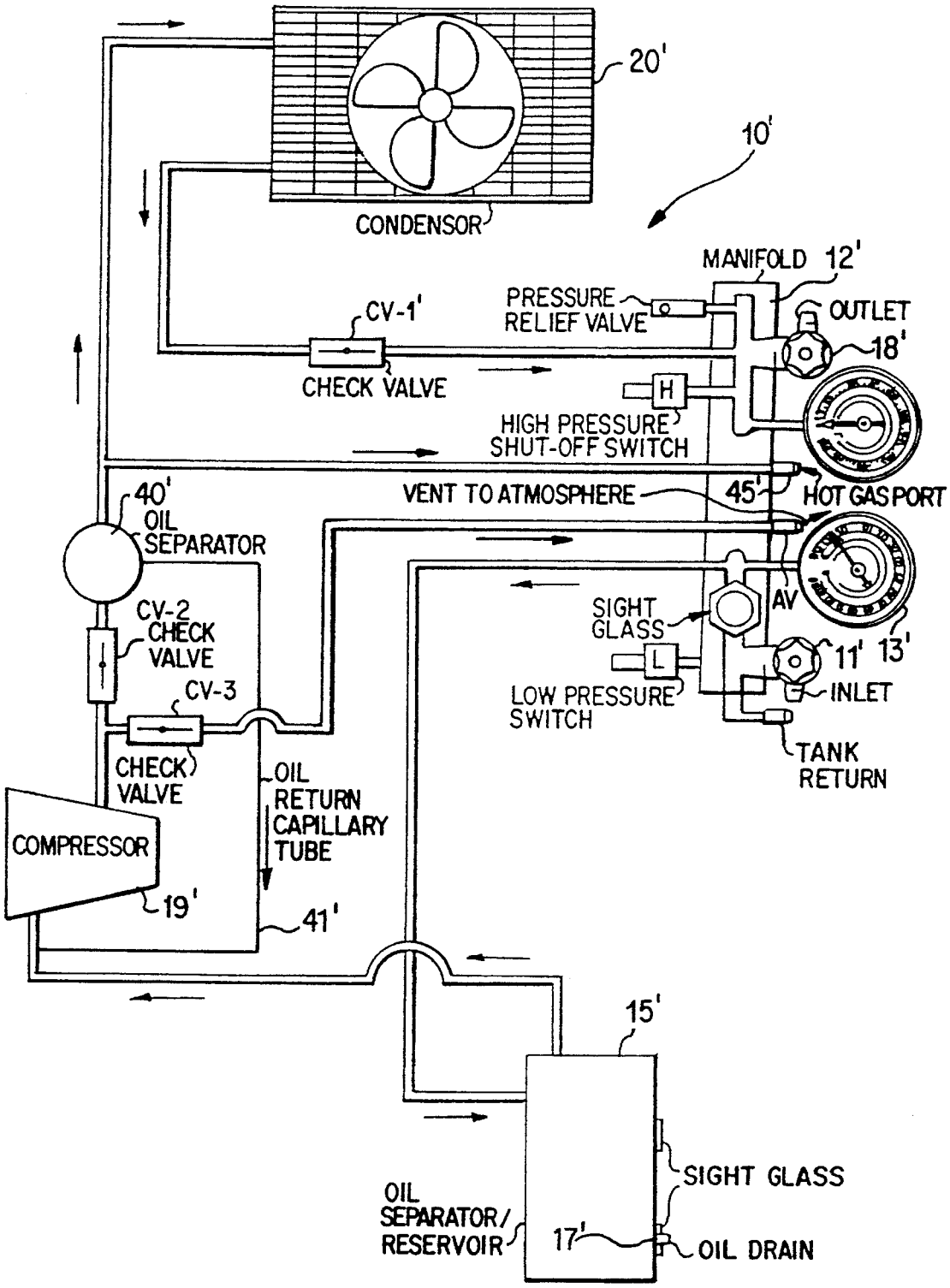
FIG. 2A is a schematic diagram of the system shown in FIG. 1 but configured as a vacuum pump with the addition of check valves and a separate vacuum discharge port.

In the embodiment of FIGS. 2A (wherein parts similar to the parts in FIG. 2 are designated with the same reference numeral but are primed), two check valves CV-2 and CV-3 are provided in addition to the check valve CV-1 between the outlet of the condenser 20 and the manifold outlet 18 shown in FIG. 2. By providing the two additional check valves CV-2 and CV-3, the system 10' can now be utilized as a vacuum pump. That is, the operator connects a hose with a standard valve core depressor to the vacuum discharge port AV, allowing the vacuum pump exhaust to vent directly to the atmosphere (as all vacuum pumps typically do). Because any refrigerant in the compressor discharge between the compressor outlet and the check valves CV-2 and CV-3, as well as in line containing check valve CV-3, is also lost to the atmosphere, these connections should be as close as practical to the compressor discharge to minimize this volume and thereby to minimize the unwanted venting. While it would be desirable to locate this vacuum discharge connection after the oil separator 40' to minimize the escape of oil into the discharge port, the volume of trapped refrigerant would be undesirably increased. Since the oil loss through the vacuum discharge is minimal, it is a better trade-off to avoid the loss of refrigerant and make the connection as close as possible to the compressor discharge rather than after the oil separator 40'.

When the unit 10' is operated as a vacuum pump, any refrigerant in the discharge oil separator 40', condenser 20' and downstream plumbing is precluded from exhausting through the vacuum discharge port AV by the check valve CV-2. Similarly, check valve CV-3 keeps air from entering the system (reverse flow) through the vacuum discharge port AV when it is connected to the ambient air and refrigerant pressure is below the ambient air pressure, such as when recovering R-11 or other low pressure refrigerants.

A significant advantage of the system 10' of FIG. 2A is that a separate vacuum pump need not be carried to the recovery site, since one unit 10' can now perform both functions. However, the compressor 20' must be capable of operating down to lower vacuums in contrast to recovery alone. For example, a standard belt-driven or semi-hermetic compressor 20' capable of operating at low vacuums is used, but otherwise a hermetic compressor can be used for recovery alone where overheating and burnout are not problems because the compressor 20 is not operating at low vacuums because it would overheat and burn-out.

Figure 2B:
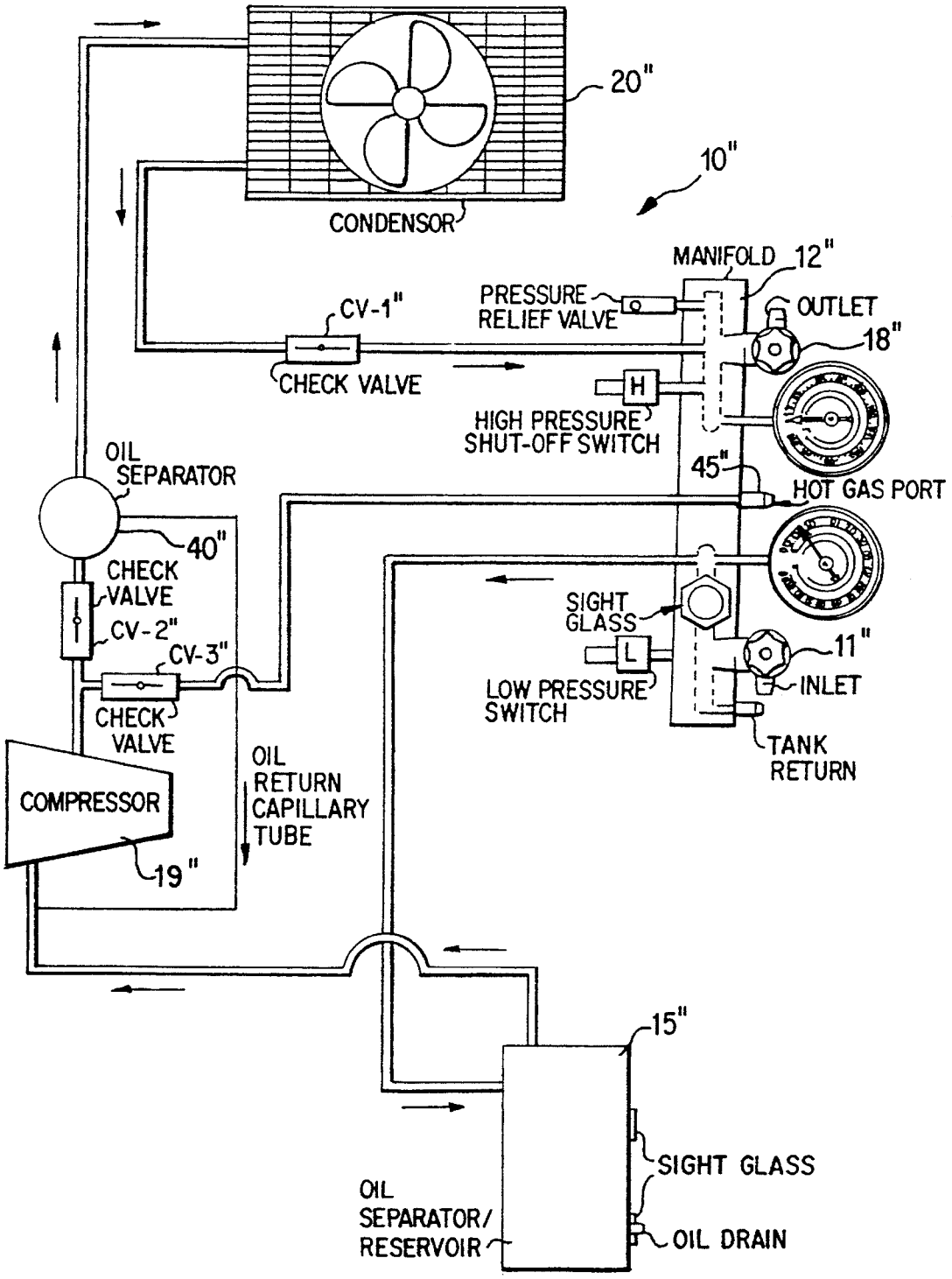
FIG. 2B is a schematic diagram of a recovery/vacuum pump system similar to FIG. 2A but without a separate vacuum discharge port.

It will be noted in the system 10' of FIG. 2A that the lines for the vacuum discharge port AV and the hot gas discharge port 45' have very similar plumbing, except that the discharge oil separator 40' is unable to separate compressor oil from the vacuum discharge port AV, because of its location upstream of the separator 40'. Otherwise, however, the function of the two lines is similar. Therefore, these lines can be combined, as shown in FIG. 2B (where parts identical to the parts in the systems of FIGS. 2 and 2A are designated by the same reference numeral but are double primed) in order to minimize costs. While the line for the combined vacuum and hot gas discharge port 4 can be located on either side of the compressor oil separator 40", it is preferred here to locate this connection directly after the compressor discharge to minimize venting of refrigerant when switching from a recovery operation to a vacuum pump operation. It is also important to mention that the check valve CV-1" is somewhat redundant in this embodiment but does serve a purpose in that when direct recovery slows down essentially to zero, the condenser temperature will drop, resulting in a drop in condenser pressure. Without check valve CV-I", liquid refrigerant from the recovery tank would be drawn backwards from the recovery tank into the recovery system 10".

Figure 5:
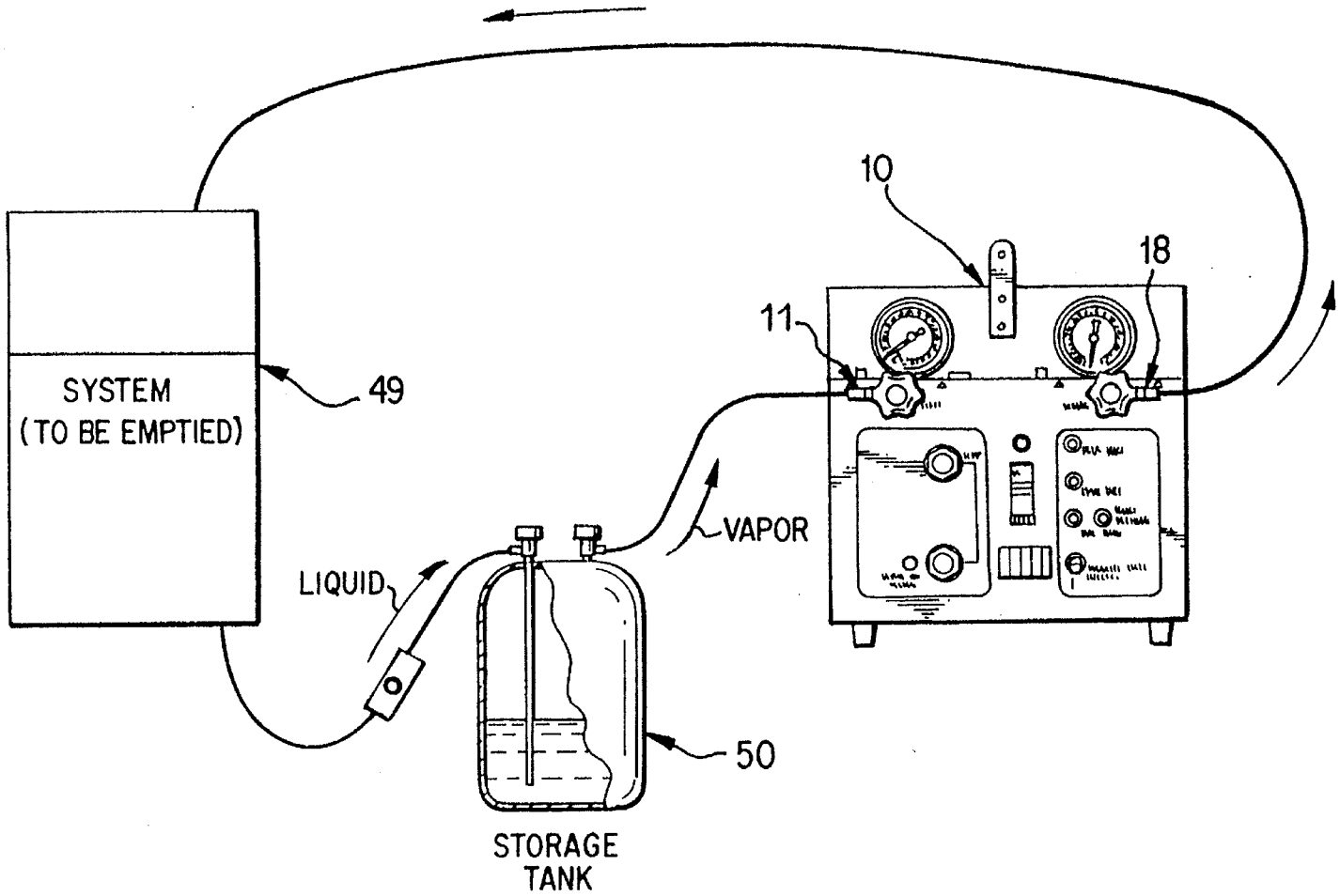
FIG. 5 is a schematic view of a known "push-pull" method using the system of the present invention shown in FIG. 2.
Figure 6:
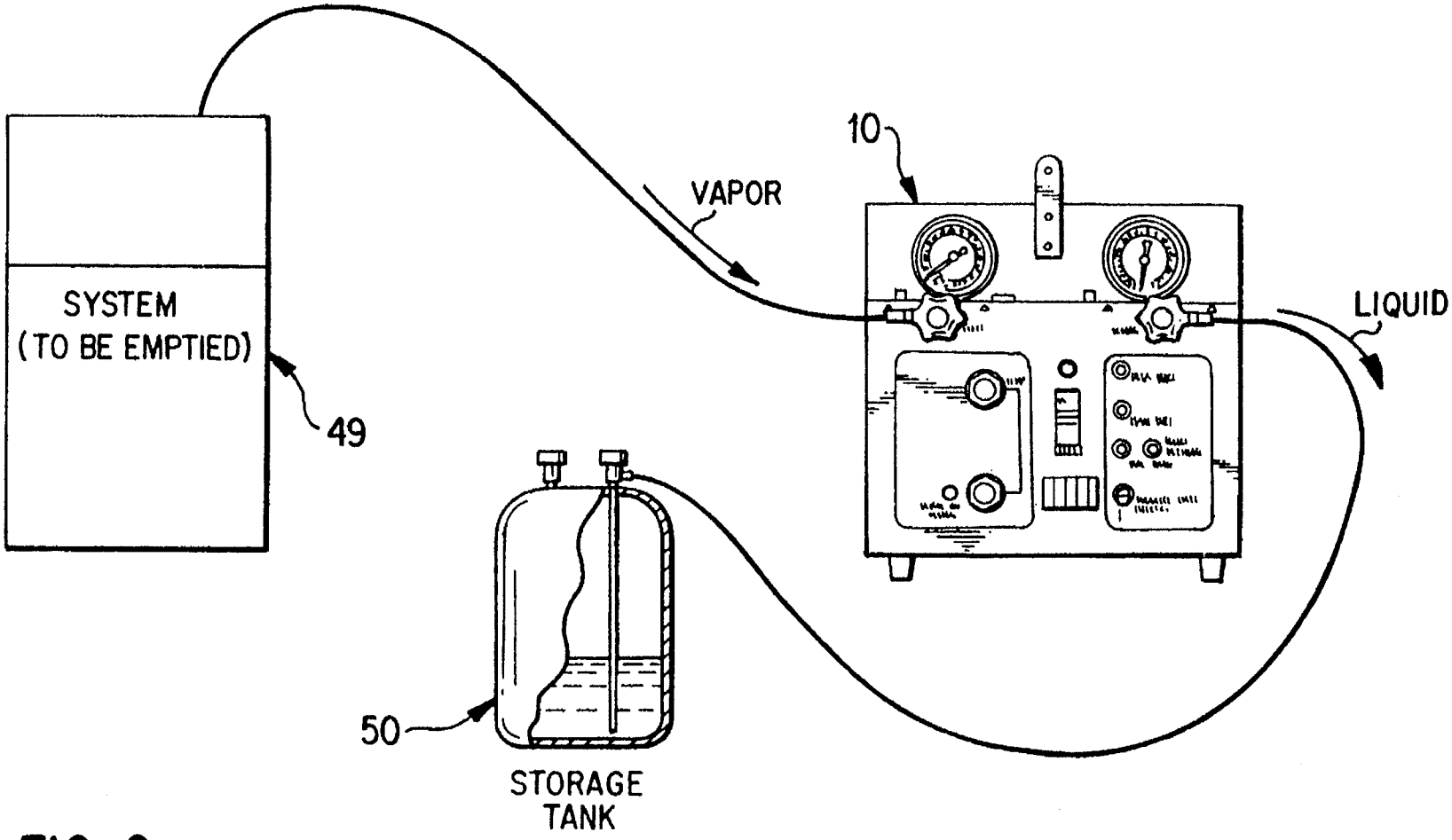
FIG. 6 is a schematic view of a known "direct recovery" method using the system of FIG. 2.

When large amounts of refrigerant are to be recovered, a "push-pull" liquid recovery method of the type shown in FIG. 5 is typically used, rather than a "direct vapor recovery" method of the type shown in FIG. 6. In the latter method, which is known, refrigerant vapor is drawn from the unit 49 to be evacuated into the recovery unit 10 where it is condensed and then it is sent to an external storage tank 50.

The "push-pull" liquid recovery method shown in FIG. 5 increases recovery rates. The recovery system 10 of the present invention is used to push refrigerant vapor into the system 49 being emptied, thereby displacing the denser liquid into the storage tank 50. To achieve this type of push-pull connection, the liquid service connection on the system 49 being emptied is connected to the liquid connection of the storage tank 50. The vapor connection on the storage tank 50 is connected to the inlet 11 of the recovery unit 10, and the outlet 18 of the recovery unit 10 is connected back to the vapor connection of the system 49 to be emptied as shown in FIG. 5. With such a hook-up configuration, the outlet 18 of the recovery unit 10 contains liquid, but it is desired to return hot gas, not subcooled liquid, to the system 49 being emptied. The recovery unit 10 of the present invention as seen in FIG. 5 returns hot gas, not liquid by closing the outlet valve 18 almost completely so that the outlet valve 18 operates like a throttling valve and the refrigerant flashes to a vapor before returning to the system 49 being emptied. This results in the desired return of saturated vapor instead of liquid and significantly improved recovery rates. This type of approach works satisfactorily if the outlet valve 18 is properly set to assure vaporization of the liquid, but we have found that, in practice, it is difficult for an operator to set this valve properly, especially without the use of an in-line sight glass in the return line.

Figure 7:
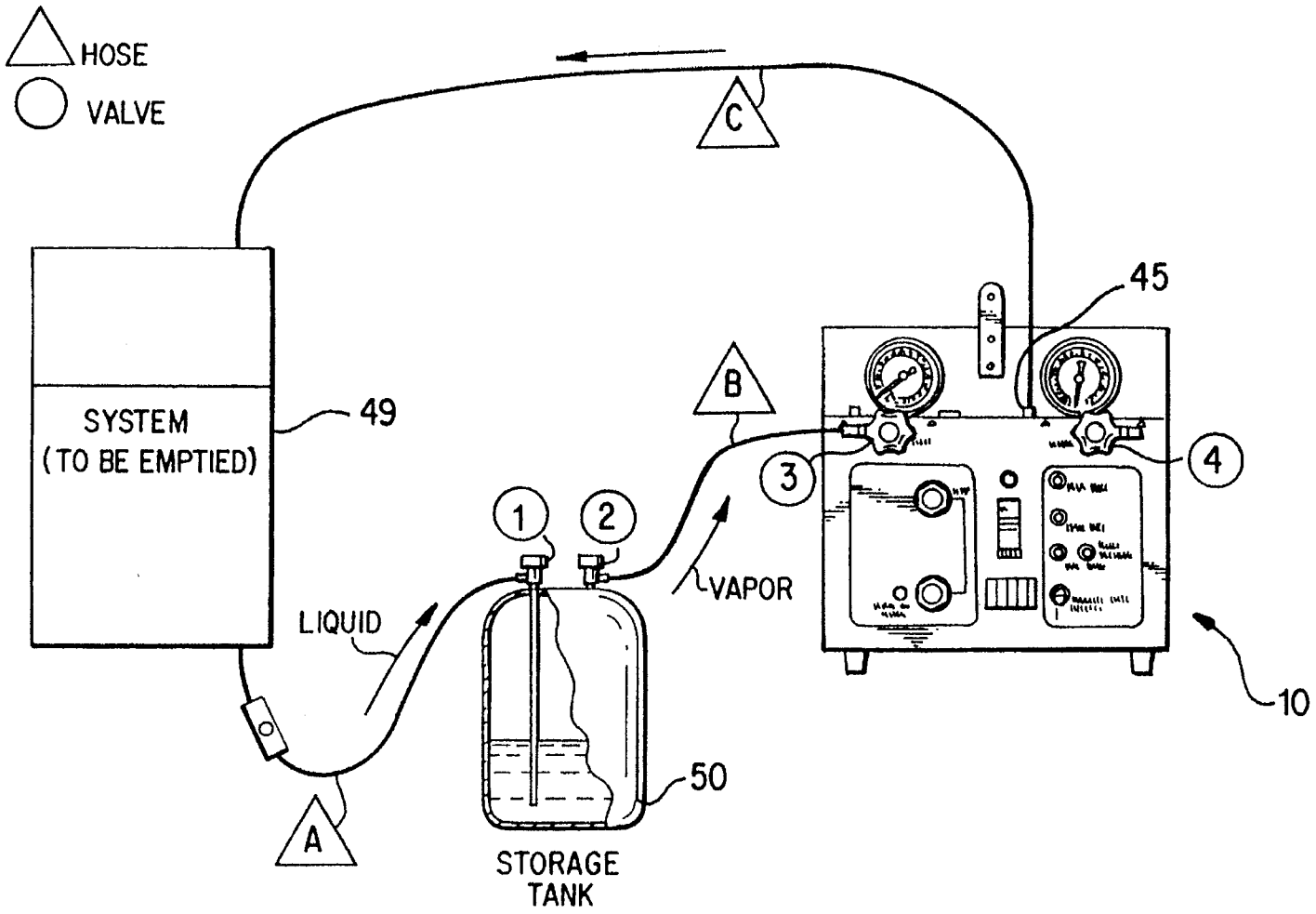
FIG. 7 is a schematic view of a novel "push-pull" method using the system of FIG. 2.

The recovery system 10 of the present invention allows the use a far easier approach as illustrated in FIG. 7. Instead of using the outlet 18, superheated refrigerant vapor which leaves the compressor 19 (FIG. 2), after passing through the compressor oil separator 40, is diverted directly to a hot gas port 45 in the manifold 12 on the front of the unit 10 (FIG. 2) so that hot superheated vapor is returned to the unit 49 being emptied. The hot vapor speeds the recovery process, and therefore the recovery rate will not be affected by the potential inability of the operator to properly set the outlet valve 18 for flashing the refrigerant. The hot gas port 45 and the check valves CV-2" and CV-3" shown in FIG. 2B allow the recovery system 10 to be used as a vacuum pump as well as a refrigerant recovery device.

Figure 8:
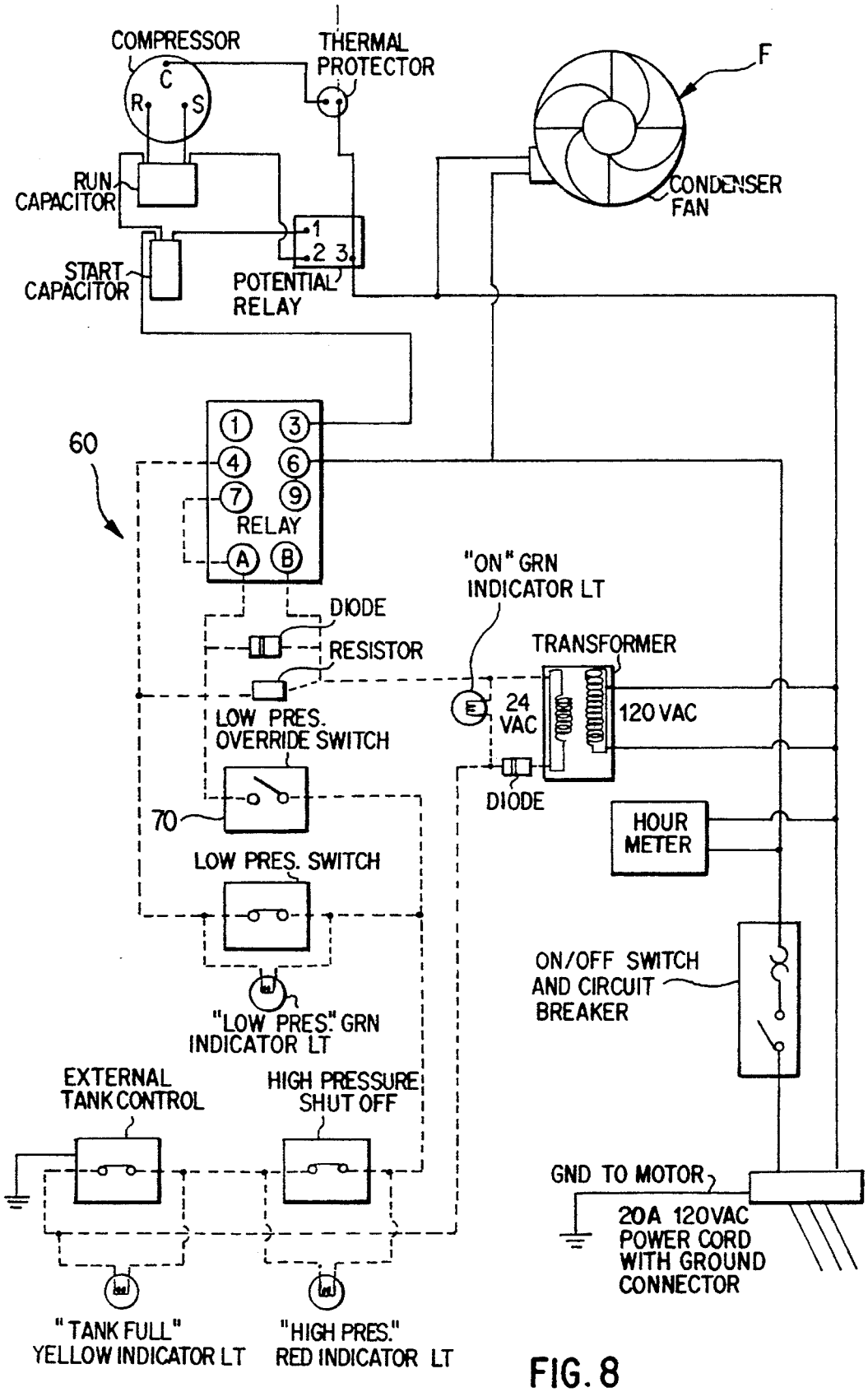
FIG. 8 is a schematic diagram of a latching circuit used for controlling operation of the system of FIG. 2.

An electric circuit for controlling the unit 10 shown in FIGS. 2, 5, 6 and 7 is shown in FIG. 8. A low-voltage control safety circuit 60 utilizes a low-pressure shut-off, high-pressure shut-off, and tank-full shut-off. This circuit is a low-voltage circuit which operates at 24 vdc to increase contact switch life. A conventional 24 vac transformer and two diodes are used to obtain dc current. Each safety switch is normally closed, allowing a low-voltage control loop to be normally closed and thereby actuate the coil of a double-pole relay. Each safety switch has a corresponding indicator light and a 1000 ohm resistor mounted in parallel to the switch.

When a normally closed switch opens due to a fault condition, the associated indicator light is illuminated, but the current flow is too low to activate the relay coil and energize the circuit. When the relay is closed, the 110 vac (or other high voltage power, i.e. 220 vac, 460 vac) is directed to the compressor. A conventional start capacitor, run capacitor, start relay, and thermal overload circuit is activated when the relay is closed by energizing the relay coil. The "tank-full" safety switch is a normally-closed magnetic-reed-type float switch located in the storage tank; the safety switch is connected to the recovery unit 10 with a three wire connection, two wires for the switch circuit and a ground wire for safety. The wiring connector on the front of the unit 10 has a shut-cap, which by-passes the float switch for occasions where a tank without a float switch is being used. This float-switch control fails-safe; that is, if the float control circuit should open, because of a damaged wire or loose connection, the unit 10 will stop the recovery operation.

To prevent the above-described low-voltage control circuit from being too sensitive to intermittent opening and closing of the safety switches, due for instance to high pressure fluctuations or agitation of the tank liquid level resulting in repeated opening and closing of the tank float switch and thereby causing short cycling of the compressor which severely shortens the compressor life, a latching circuit is added to the control circuit so that the circuit initially is not completed with all the safety switches closed until a momentary manual start/override switch 70 is depressed by the operator. Depressing switch 70 completes the low-voltage circuit, and causes the relay to close so that the second contact on the relay, which is wired in parallel to the manual start switch 70, is closed to complete the circuit, and the manual start switch need not be depressed anymore. This manual start switch 70 is wired in parallel to both the relay contact and the low-pressure switch to also serve as a low pressure override and allow the operator manually to over-ride the low-pressure cutoff as long as the switch 70 is depressed.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A refrigerant system servicing manifold for use in a refrigerant recovery system, comprising an inlet port with an associated shut-off valve;

a low pressure switch operatively associated with the inlet port;

an outlet port with an associated shut-off valve;

a high pressure switch operatively associated with the outlet port; and a sight glass arranged at the inlet port;

wherein the foregoing components are assembled and incorporated into the manifold.

2. The manifold according to claim 1, wherein a hot gas port is provided in the manifold for effecting a push pull method.

* * * * *